US005520508A

United States Patent [19]

Khalid

[11] Patent Number: 5,520,508

[45] Date of Patent: May 28, 1996

[54] COMPRESSOR ENDWALL TREATMENT

[75] Inventor: Syed J. Khalid, Palm Beach Gardens, Fla.

[73] Assignee: United Technologies Corporation, Hartford, Conn.

[21] Appl. No.: 350,208

[22] Filed: Dec. 5, 1994

[51] Int. Cl.[6] ..... F01D 5/10

[52] U.S. Cl. ..... 415/119; 415/173.1; 415/914

[58] Field of Search ..... 415/173.1, 119, 415/9, 57.4, 914

[56] References Cited

U.S. PATENT DOCUMENTS

| | | | |
|---|---|---|---|
| 3,365,172 | 1/1968 | McDonough et al. | 415/914 |
| 4,086,022 | 4/1978 | Freeman et al. | 415/914 |
| 4,540,335 | 9/1985 | Yamaguchi et al. | 415/914 |
| 4,714,406 | 12/1987 | Hough | 415/914 |
| 4,781,530 | 11/1988 | Lauterbach et al. | 415/914 |
| 5,160,248 | 11/1992 | Clarke | 415/119 |

*Primary Examiner*—John T. Kwon
*Attorney, Agent, or Firm*—Robert E. Greenstien

[57] ABSTRACT

The compressor section of an insert gas turbine engine contains a insert installed around the compressor blades that includes cells in a honeycomb configuration. Each cell is inclined at a compound angle to the blade tip to energize the tip air flow as the tip passes over the cell as the blade rotates, improving stall margin with minimum efficiency loss. Each cell is oriented in the direction of the blade chord and faces the advancing blades. As the blade rotates, it sweeps by each cell and high pressure airflow is first captured in the cell from the high pressure side of the blade and released to the low pressure side as the blade passes the cell in the form of a transient energizing jet of high velocity flow in the direction of the airflow across the blade thereby providing effective mixing of the endwall flows and enhancing the tip flow streamwise momentum.

15 Claims, 5 Drawing Sheets

COMPRESSOR ENDWALL TREATMENT

This invention was made under a U.S. Government contract giving the Government rights herein.

TECHNICAL FIELD

This invention relates to gas turbines, in particular, techniques for improving compressor stall characteristics.

BACKGROUND OF THE INVENTION

In a gas turbine engine, compressor blades are attached to a rotating disk with the blade tips as close as possible to the "endwall". Different sealing techniques are used to minimize the adverse effects of tip-endwall clearance and tip rub on the seal. Compressor rotor blade tip-endwall clearance growth significantly reduces compressor stall margin, mainly due to leakage between the pressure and suction sides of the blade. That leakage reduces total streamwise flow momentum through the blade passage, reducing blade pressure rise capability and therefore stall margin. A plot of pressure across the blade from root to tip would show a drop in total pressure towards the tip, due to that leakage. Stall margin loss from clearance increases perhaps arises from an interaction between the endwall and the blade suction side boundary layers, a condition that potentially could cause boundary layer flow separation on the suction side, causing flow blockage in that area.

DISCLOSURE OF THE INVENTION

An object of the present invention is to provide improved compressor stall margin by minimizing the adverse effect of tip clearance between the endwall and the compressor blade tips and by actively improving the flow characteristics near the blade tip.

According to the present invention a special aerodynamic structure is placed between the blade tips and the endwall that "energizes" the tip flow in a way that enhances the streamwise momentum and produces efficient mixing of the endwall flows.

According to the present invention, a shroud insert is placed in the endwall around the compressor blades that contains dead-ended honeycomb cells inclined at a compound angle. One angle component is relative to a tangential axis in the direction of blade rotation and the second angle component is relative to the radial (normal) orientation of the blades. As the blade pressure side advances, the honeycomb cells are "charged" with pressure side air and as the blade crosses each cell, the cell vents to the suction side, producing a transient jet of high velocity flow emanating from the cell that energizes the endwall flow.

The compound angle of the cell is selected to achieve two main objectives. The cell is oriented to face the advancing blade pressure side to capture the dynamic pressure imparted by the moving blade. This ensures that the cell is charged with air that is effective in producing an effective jet inducing pressure ratio. Also, the cell's orientation is along the chord of the blade, so that that the resulting jet direction has a significant component in the streamwise direction, which enhances the streamwise flow momentum. The high velocity jets from the cells at this compound angle produce efficient mixing of the outermost endwall flows (the stability impacting region) without disrupting the main flow, which minimizes efficiency losses. Components of the jets in the streamwise direction augment the streamwise momentum, a condition evidenced by the increased total pressure in the tip region.

According to the invention, the cell size is selected to result in a cell emptying time constant that is a fraction of the blade passing time period. The cell diameter (normal to the cell axis) is in the order of the blade thickness, and the cell length of depth (along the cell axis) is the range of one to seven times.

A feature of the invention is that it provides superior stall margin characteristics with minimal loss in compressor efficiency by energizing the flow field near the endwall (whether it is stationary or rotating). Another feature is that it can be used to improve the lift characteristics between an endwall and the tip of a lifting surface. For instance, in a compressor stator secton, an insert with these cells can be placed on the rotating drum that faces the stator vane tips. Other objects benefits and features of the invention will be apparent to one skilled in the art from the following discussion.

BEST MODE FOR CARRYING OUT THE INVENTION

Figure 1:
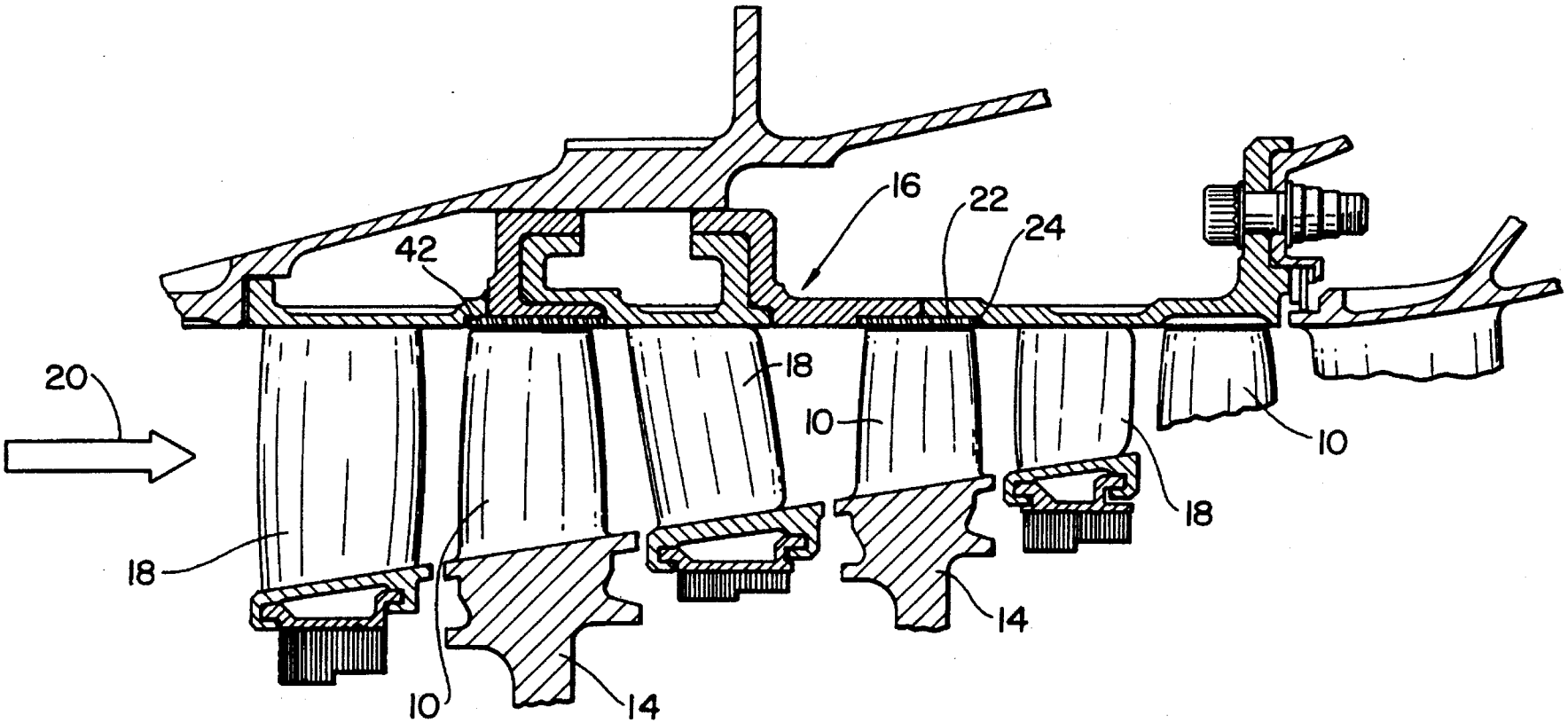
FIG. 1 is a sectional along line 1—1 of a typical gas turbine engine, shown in FIG. 8.
Figure 2:
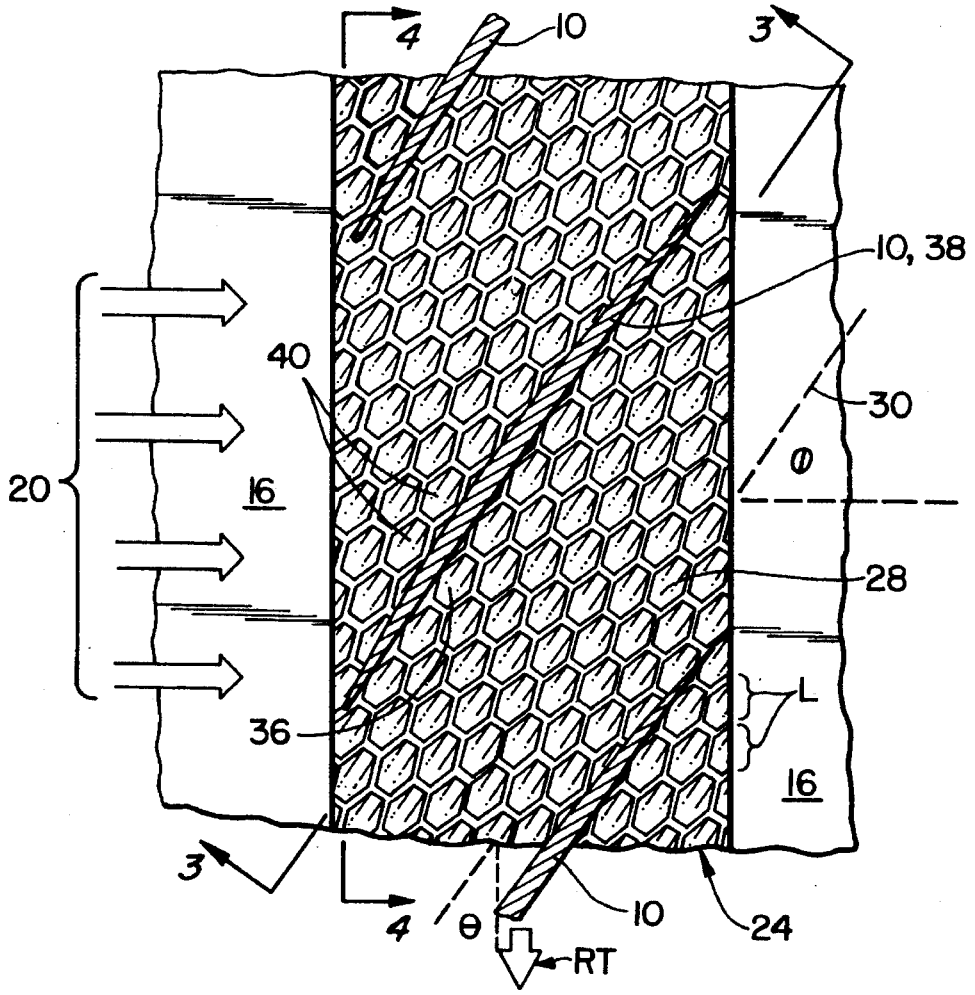
FIG. 2 is a plan view of section of a shroud surrounding the blades according to the present invention.
Figure 3:
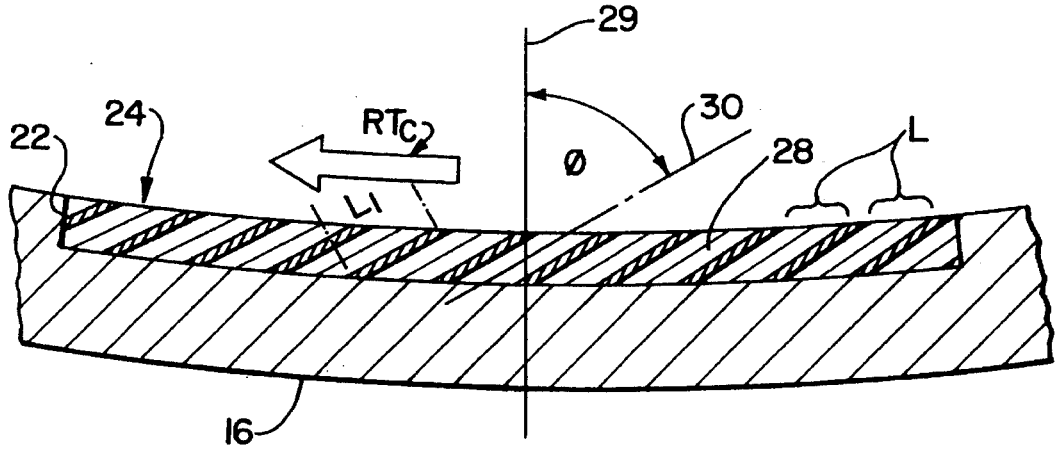
FIG. 3 is a section along line 3—3 in FIG. 2.
Figure 4:
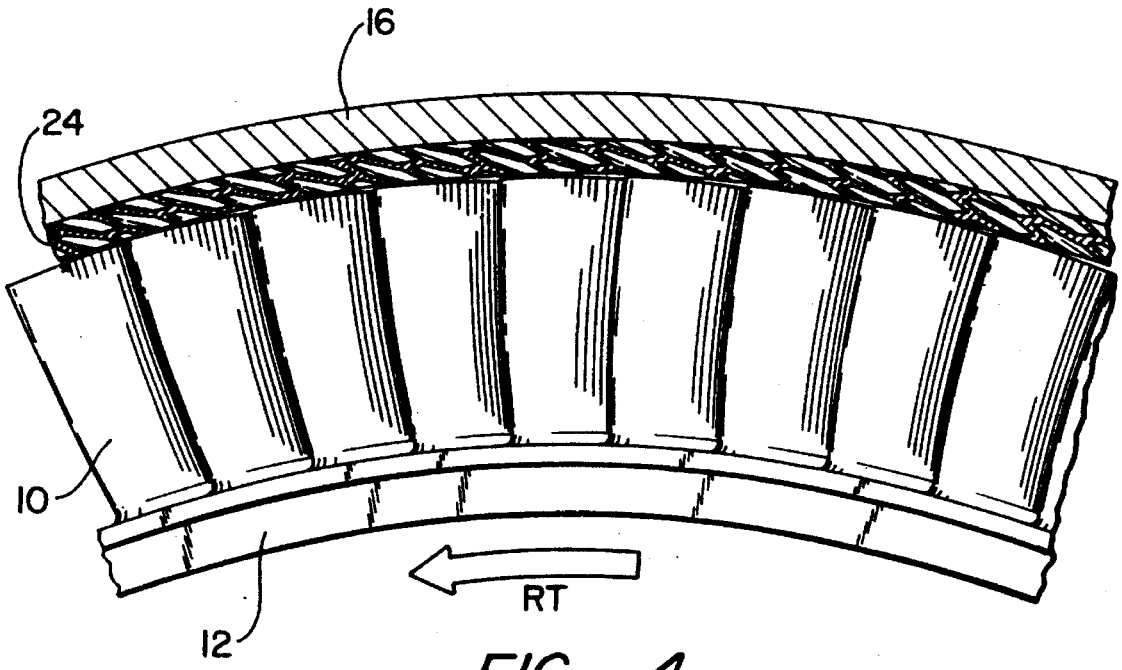
FIG. 4 is section along line 4—4 in FIG. 2.
Figure 5:
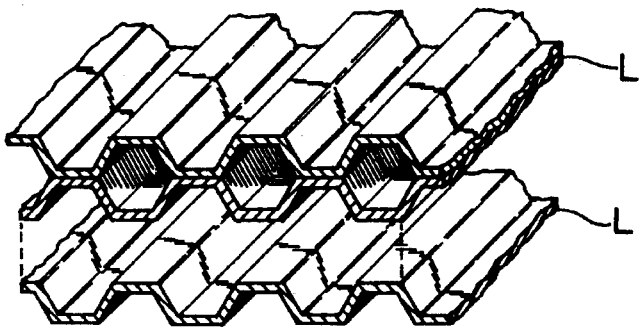
FIG. 5 is a an exploded view showing two layers of the shroud.
Figure 6:
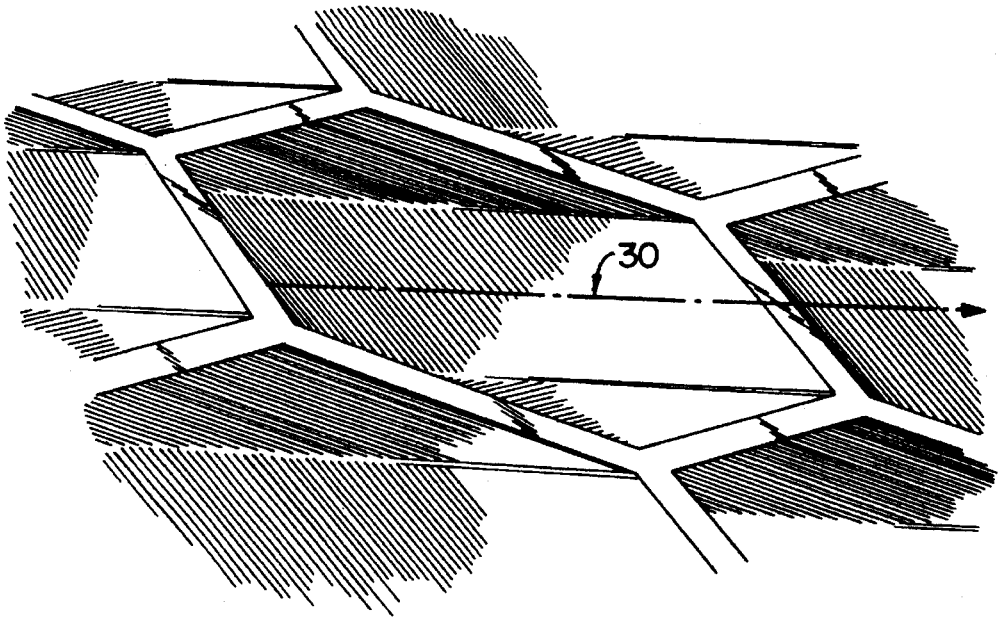
FIG. 6 is a perspective of several cells in the shroud.
Figure 8:
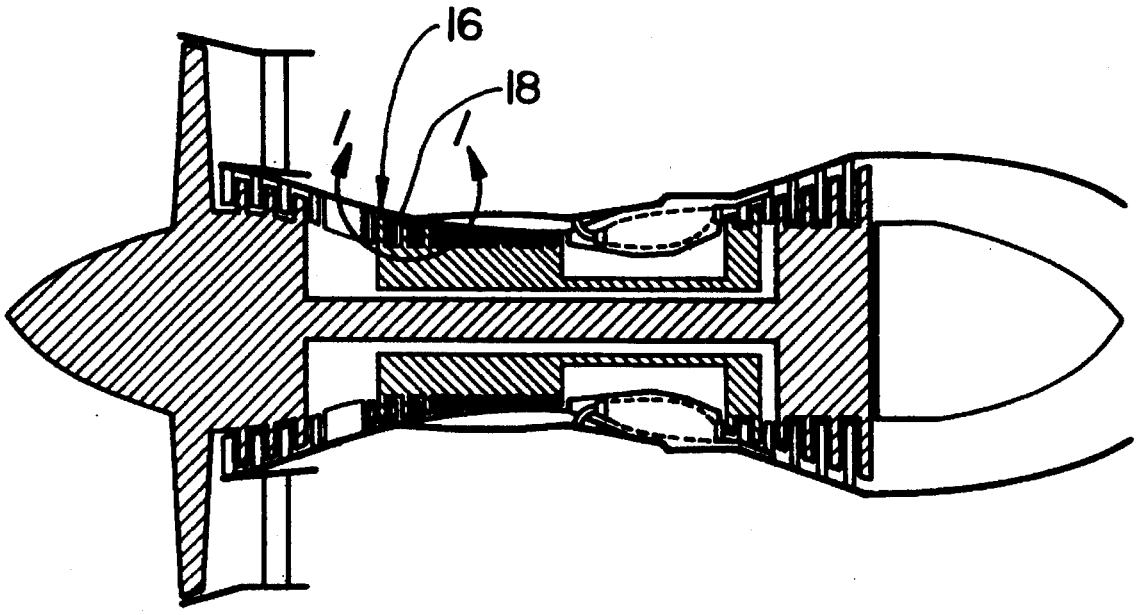
FIG. 8 shows a gas turbine engine in which the shroud is included.

In FIG. 1 a plurality of compressor turbine blades 10 are attached to respective compressor disks 14 with a case 16. The blades and disks are part of typical compressor section in a gas turbine engine, shown in FIG. 8. Stator vanes 18 are located upstream of the blades 10 to direct airflow 20. A circumferential seat 22 is provided in the case 16 to receive a ring insert 24 comprising layers of honeycomb cells 28, these being better shown in the enlarged view in FIG. 2. There, the arrow RT indicates the direction of blade rotation and the airflow to the compressor is again the arrow number 20. FIG. 1, shows that the insert 24 is constructed of layers L of the cells 28, and the cells, it will be noted, are oriented at a compound angle: one angle $\theta$, a second angle $\phi$. The angle $\theta$ defines the displacement of the cell axis 30 from the blade tangential direction, RT in FIG. 2.. The angle $\phi$ defines the displacement of the cell axis from the normal (radial direction) 29. It is perhaps easier to see in FIG. 3 that the cell axis 30 is oriented such that cell opening faces the advancing blade, moving in direction RT. The cells are also on the chord line of the blades. The significance of these characteristics will be explained below.

As the blades rotate they sweep past the cells 28. This exposes the cells to different pressure conditions as a function of blade position. For example, refer to the one cell 36, and the blade 38 in FIG. 2, which shows the blade location at $t_0$. The cell is located at the high pressure side of the blade 36, but as the blade rotates in the direction RT it will be exposed to the low pressure side at a later time $t_{+1}$, as are the cells 40, which were pressurized at an early time (blade position) $t_0$. For clarity, it should be observed that arrow Rtc in FIG. 3 indicates the component of blade velocity along the line 3—3 in FIG. 2.

Figure 7:
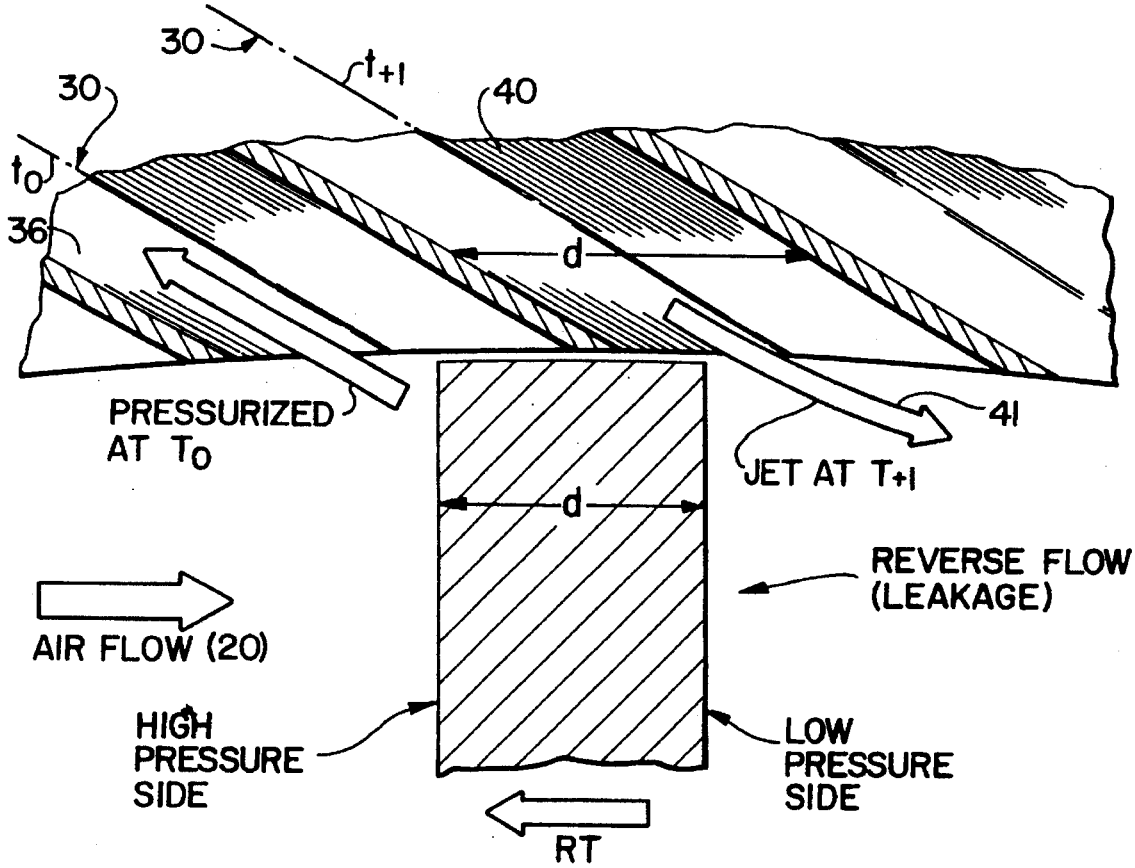
FIG. 7 is an enlargement showing a blade tip and an adjacent layer of the shroud.

Referring to FIG. 7, the cell 40, pressurized initially at to from the high pressure side, as is the cell 36, provides a burst or jet of air 41 to the low pressure side of the blade after the blade passes over the cell. In addition to orientation of the cells relative to the blade or "air foil or lifting surface", the blade thickness should be about d, the diameter of the cell and the depth or thickness of the cell L1 at least equal to d and preferably four times d. The ratio is important because it controls the time constant associated with the charging and discharging of the cell. The transient jets, with velocity components in the blade passage direction (due to the compound angle), produce energized flow at the blade tip, which causes efficient mixing, thereby preventing any potential flow separation in the endwall region.

The magnitude of the $\theta$ and $\phi$ depends on the specific compressor design, but essential so that the cells are charged correctly and the outflow, energizing jet on the low pressure side is correctly oriented. Exemplary values for those angles are as follows: $\theta$=34 degrees and $\phi$=60 degrees.

The invention significantly improves the stall margin of the compressor with minimum efficiency loss by efficiently energizing the endwall flow field. Test of the design have also shown that the orientation of the cell angles is such as to make the insert a good abradable seal because the angled cells are shaved off easily without wearing the blade when a blade tip, having an abrasive tip (known in the art) rubs against the insert.

The favorable cell flow/tip flow interaction provided by the invention may be employed in the turbine section of a gas turbine engine by utilizing a turbine tip shroud having properly angled dead-ended cells, but with an important difference in cell pressurization as the turbine blade rotates. In the compressor embodiment, described above, the cell is first exposed to the pressure side of the blade and then the lower pressure side. In a turbine, the cell is first exposed to the low pressure side, lowering the pressure in the cell and thereby inducing flow into the cell when the blade transits the cell. Leakage through the clearance between the turbine tip and the endwall is reduced by this transient flow migration into the axis due to increased baffling, thus improving turbine efficiency.

With the benefit of the foregoing discussion and explanation, one of ordinary skill in the art may be able to modify, in whole or in part, a disclosed embodiment of the invention without departing from the scope and spirit of the invention.

I claim:

1. A gas turbine engine comprising a compressor stage having a case and compressor blades, characterized by:

an insert between the case and tips of the compressor blades comprising first means for capturing pressurized airflow from the high pressure side of blade tips to provide pressurized airflow in the direction of the airflow across the blade to the low pressure side of the blade as the blade rotates.

2. The gas turbine engine described in claim 1, further characterized in that said first means comprises a plurality of cells in which each cell is oriented at a first angle to the tangential direction in the direction of blade rotation to point downstream in the streamwise direction and at a second angle greater than thirty degrees to a line normal to the case.

3. The gas turbine engine described in claim 1, further characterized in that said first means comprises a plurality of cells in which each cell extends towards the blade tip at an angle to a line tangential to the direction of blade rotation and at a second angle greater than thirty degrees to a line normal to the case.

4. The gas turbine engine described in claim 2, further characterized in that said insert comprise a layers of honeycomb sheets each comprising said cells.

5. The gas turbine engine described in claim 2, further characterized in that said insert comprises layers of honeycomb sheets comprising said cells.

6. The gas turbine engine described in claim 5, further characterized in that the cells are polygons with a diameter that substantially equals the blade thickness and a depth that is no less the diameter.

7. The gas turbine engine described in claim 6, further characterized in that the cells are polygons with a diameter that substantially equals the blade thickness and a depth that is no less the diameter.

8. The gas turbine engine described in claim 6, further characterized in that the length is more than the diameter.

9. The gas turbine engine described in claim 7, further characterized in that the length is more than the diameter.

10. A method for energizing the tip of an airfoil facing an endwall, the airfoil having motion to the endwall, characterized by the steps:

installing an insert between the endwall and tip, the insert comprising first means for capturing pressurized airflow from the high pressure side of blade tips to provide pressurized airflow in the direction of the airflow across the blade to the low pressure side of the blade as the tip moves relative to the endwall.

11. The method described in claim 10, further characterized by:

the insert comprising a plurality of cells in which each cell extends towards the tip along the airfoil chord and at an angle that is greater than ten degrees from a line that is tangential to the direction of airfoil rotation.

12. The method described in claim 11, further characterized in that:

said insert comprises a plurality of cells in which each cell is oriented at an angle so that the cell axis has a component [along the blade chord]in the axial direction and at a second angle greater than thirty degrees to the [blade]normal to endwall.

13. The combination of an endwall and an airfoil having rotational movement relative to the endwall, characterized by:

an insert between the endwall and a tip of the airfoil, the insert comprising first means for capturing pressurized airflow from the high pressure side of the tip to provide pressurized airflow in the direction of the airflow across the tip to the low pressure side of the blade as the airfoil moves relative to the endwall.

14. The combination of an endwall and an airfoil having rotational movement relative to the endwall, characterized by:

an insert between the endwall and a tip of the airfoil, the insert comprising a plurality of cells, each cell being exposed the high and low pressure side of the airfoil as the airfoil rotates and at a compound angle to the direction of said rotational movement.

15. The combination described in claim 14, further characterized by:

the insert comprised a plurality of cells in which each cell extends towards the tip along a line defining the chord of the airfoil and at a first angle greater than ten degrees to a line that is tangential to the direction of the relative motion of the airfoil, and a second angle greater than thirty degrees from the normal to the endwall and the diameter of each cell substantially equals the blade tip thickness and the cell depth is at least equal to the diameter of the cell.

* * * * *